US008113679B2

(12) United States Patent
Witsenburg et al.

(10) Patent No.: US 8,113,679 B2
(45) Date of Patent: Feb. 14, 2012

(54) LIGHT SYSTEM AND METHOD FOR CREATING A LOCALIZED LIGHT

(75) Inventors: Joost Ewout Witsenburg, Rotterdam (NL); Elmo Marcus Attila Diederiks, Eindhoven (NL); Bartel Marinus Van De Sluis, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 772 days.

(21) Appl. No.: 12/096,614

(22) PCT Filed: Dec. 8, 2006

(86) PCT No.: PCT/IB2006/054709

§ 371 (c)(1),
(2), (4) Date: Aug. 26, 2008

(87) PCT Pub. No.: WO2007/069163

PCT Pub. Date: Jun. 21, 2007

(65) Prior Publication Data

US 2009/0016046 A1 Jan. 15, 2009

(30) Foreign Application Priority Data

Dec. 12, 2005 (EP) ..... 05111988

(51) Int. Cl.
*F21V 33/00* (2006.01)
*F21V 21/00* (2006.01)
*F21S 8/00* (2006.01)

(52) U.S. Cl. ..... 362/132; 362/133; 362/576; 362/145; 362/147; 362/148; 362/149; 362/150; 362/217.01

(58) Field of Classification Search ..... 362/576, 362/132, 133, 145, 147–150, 217.01–225
See application file for complete search history.

(56) References Cited

U.S. PATENT DOCUMENTS

| | | | | |
|---|---|---|---|---|
| 5,450,299 | A | 9/1995 | Lepre | |
| 6,543,912 | B1 * | 4/2003 | Simon | 362/327 |
| 6,582,096 | B1 * | 6/2003 | Searer | 362/253 |
| 2003/0111435 | A1 | 6/2003 | Chen | |
| 2003/0179578 | A1 * | 9/2003 | Albert et al. | 362/276 |
| 2005/0060246 | A1 * | 3/2005 | Lastinger et al. | 705/28 |

FOREIGN PATENT DOCUMENTS

| | | | |
|---|---|---|---|
| DE | 29915823 | U1 | 1/2001 |
| FR | 2883362 | A1 | 9/2006 |
| JP | 2005183222 | A | 7/2005 |

* cited by examiner

*Primary Examiner* — William Carter
(74) *Attorney, Agent, or Firm* — Mark L. Beloborodov

(57) ABSTRACT

The invention relates to the creation of a localized light, particularly to a light system (12) for creating a localized light illuminating for example clothing hanging on the rail. The light system comprises lighting means (16,17) and lighting control means (18,19) which are adapted to create the localized light (14) responsive to user actions with objects hanging on a rail (10). Thus, a user browsing for example clothing hanging on the rail always has sufficient localized light for watching the clothing even in a situation with dimmed ambient lighting.

21 Claims, 2 Drawing Sheets

LIGHT SYSTEM AND METHOD FOR CREATING A LOCALIZED LIGHT

The invention relates to the creation of localized light, particularly to a light system and method for creating a localized light illuminating for example clothes hanging on a rail.

Studies have shown that a convenient atmosphere in shops may stimulate the desire to buy something. For example, background music or a dimmed ambient lighting may create a pleasant atmosphere. Often, a dimmed lighting is preferred in shops because it looks more elegant than a dazzling lighting. However, a dimmed lighting makes it more difficult for shoppers to choose from the range of offered goods, particularly from clothes hanging on a clothing rail, because the goods may not be seen so good in the dimmed lighting. Moreover, without sufficient light, it is difficult for a shopper to see for example the colors of clothes, especially while browsing through the clothes hanging on a clothing rail. Also, the shopper often sheds a shadow exactly where she or he is looking at clothing hanging on a clothing rail since the background light is blocked by the shopper.

Thus, it is an object of the present invention to provide sufficient lighting for seeing characteristics of objects for example clothing hanging on a clothing rail or a curtain rail.

In order to achieve the object defined above, the invention provides a light system for creating a localized light, wherein the light system comprises the following characteristic features:

lighting means, and lighting control means adapted to create the localized light by adjusting the light from the lighting means responsive to user actions with objects hanging on a rail.

In order to achieve the object defined above, the invention further provides a method for creating a localized light, wherein the method comprises the following characteristic features:

lighting means are provided, and lighting control means create the localized light by adjusting the light from the lighting means responsive to user actions with objects hanging on a rail.

The characteristic features according to the invention provide the advantage that they allow to create a localized lighting which locally illuminates objects so that the characteristics of the objects may be seen. For example, the localized light may illuminate clothing hanging on the rail. Furthermore, the invention allows to adapt the lighting created by the lighting means of the rail responsive to user actions such as browsing clothing hanging on the rail or moving a curtain hanging on the rail. Thus, a user has a localized light which does not disturb the atmosphere of a dimmed ambient lighting but offers sufficient lighting in a limited area, for example for watching clothing or when entering or leaving a clothing changing cubicle in a shop. The localized light is automatically created responsive to user actions with objects hanging on the rail. Thus, a user who moves objects such as clothes hanging on a rail according to the invention may obtain always automatically a sufficient localized light illuminating the object(s) which is(are) most likely watched by the user. Briefly summarized, the invention creates the localized light automatically and in real time.

It should be noted that the term "rail" used herein comprises any rail- or rod-like shaped element such as for example a clothes rail or a curtain rod. The term "lighting means" used herein comprises any light emitting devices or elements and is not restricted to certain light emitting elements. For example, the lighting means may comprise a fluorescent tube or lamp, a light bulb, a halogen lamp, incandecent lamps or light emitting diodes (LEDs). The term "lighting control means" means any element with which the light emitted by the lighting means may be adjusted like mechanical means, for example adjustable apertures, sleeves or covers, and electrical means, for example electrical switches for switching the lighting means on or off or an electronic dimmer for controlling the light intensity emitted by the lighting means. The term "localized light" means a light essentially limited to a certain area in contrast to ambient light which is in principle not limited but creates a diffuse light. For example, a spot light may be understood as a "localized light" as used herein while the diffuse light not restricted at all to any area such as it is created by a standard light bulb without any apertures may not be understood as a "localized light".

According to one embodiment of the invention, the lighting means may be integrated in the rail and distributed over a predefined length of the rail. However, the lighting means may also be integrated in a separate unit which may be adapted to communicate with the lighting control means, for example via wireless connection such as a radio frequency or optical communication connection. The latter embodiment offers more freedom in placing the lighting means. For example, the lighting means may be located above a rack containing a clothing rail or a bit in front of the rack that is adaptive to user actions with the clothing hanging on the clothing rail.

According to embodiments of the invention, the lighting control means may be adapted to detect user actions by means of detecting the position, orientation and/or movement of at least one hanger hanging on the rail and/or by means of detecting touching of at least one hanger hanging on the rail. The lighting control means may be further adapted to distinguish a touching from a person from a touch of an object, for example by using computer vision techniques or special sensing techniques.

According to embodiments of the invention, the lighting means may be implemented by at least one fluorescent tube, light emitting diodes, halogen lamps, and/or incandecent lamps. The fluorescent tube or lamp may form a part of the rail, or may form the rail itself assuming that it is stable enough to carry a certain load hanging on the hangers. A fluorescent tube has the advantage that it is not costly to implement. LEDs have the advantage that they have a long lifetime and a low power consumption. For example, the rail may be a metal rod with integrated LEDs.

According to an embodiment of the invention, the lighting control means may comprise sleeves movable arranged on a rod comprising the lighting means, wherein at least one of the sleeves comprise at least one connection for a hanger. In this embodiment, the localized light may be created by movable sleeves of the rod which have an effect like adjustable apertures for controlling the light emitted from the lighting means. The hangers may be used for clothing or a curtain. Thus, the localized light is adapted to the positioning of hangers on the rail and, for example, to the browsing of clothing by a shopper. For example, when two neighbored sleeves comprise a gap, a localized light is created due to the formed aperture between the two sleeves. The lighting control means may also comprise covers movable integrated into a rod comprising the lighting means, wherein at least one of the covers comprise at least one connection for a hanger. Several other embodiments of mechanical lighting control means may be provided depending for example on the shape and form of the element which comprises the lighting means.

According to an alternative embodiment of the invention, the lighting control means may comprise at least one sensor integrated into the rail and adapted to detect whether a hanger is hanging on the rail.

According to an embodiment of the invention, the at least one sensor may be implemented by one single sensor covering the length of the rail. The term "covering the length of the rail" used herein means that the coverage of the sensor encompasses either the entire length of the rail or at least an functional length of the rail on which objects may hang. The single sensor may be either integrated into the rail or separated from the rail, for example mounted in a clothing rack above the rail and sensing the functional length of the rail. According to another embodiment of the invention, several sensors may be provided and each of the sensors may control at least one light emitting device depending on the detection of a hanger.

Preferably, each sensor is located in the neighborhood of the light emitting devices controlled by the respective sensor. Thus, the localized light may be created in the area in which hangers are moved or positioned on the rail. For example, a shopper browsing clothes on the rail may automatically create a localized light at the position where she or he is browsing the clothing.

The sensors may be arranged in a line or row, respectively, on the rail, i.e., one by one. Then, the light emitting devices may be also arranged in a line or row, respectively, on the opposite side of the sensors on the rail. This is advantageous for clothing hangers.

A further line of sensors may be arranged in parallel to the first line of sensors on the rail so that a double row of sensors is created. This double row of sensors instead of a single row allows to determine further information about how hangers are positioned on the rail, for example whether a hanger diagonally hangs on the rail. This information allows to further control the localized light, for example to illuminate a piece of clothing the side of which is facing forward because it is diagonally hanging on the rail so that a shopper can see the forward facing side of this piece of clothing.

A sensor may be adapted to switch off the controlled light emitting devices when detecting a hanger, and to switch on the controlled light emitting devices when no hanger is detected. This is helpful when clothing hangs on the rail. Then, the gaps between the clothing are illuminated so that the pieces of clothing hanging on the sides of a gap are illuminated and may be seen.

A very pleasant lighting may be achieved if the switching of the controlled light emitting devices has a soft transition. This concerns transitions in the intensity over time, rather than just dimming.

For reliably detecting the position of a hanger, the sensors may comprise pressure sensors, capacitive sensors and/or resistance sensors. When the hangers are made of metal or comprise metal element, the capacity or resistance change created by moving a hanger on the rail may be detected by capacitive or resistance sensors since the metal contained in a hanger may influence a capacitive or resistance sensor. A pressure sensor has the advantage that it does not require any metal since it detects the pressure created by the load of a hanger resting on the sensor.

In a preferred embodiment of the invention, a central controller may be provided which receives signals from the sensors and which is adapted to control the switching of the light emitting devices depending on the received sensor signals. The central controller may be a microcontroller programmed to process signals received from the sensors and to control the light emitting devices according to an algorithm for controlling the lighting. For example, the central controller may be implemented such that it may create lighting effects like dimming the localized light with a time delay or according to a predetermined behavior. For example, the central controller may control the light emitting devices so that the devices which are close to the sides of a gap of clothing hanging on the rail emit a brighter light than the devices located in the middle of the gap so that a shopper may see the pieces of clothing hanging at the sides of the gap. The central controller may be also programmed to dim a light emitting device after a certain time after detecting a hanger by the sensor assigned to the device. Thus, the light "follows" the browsing of clothing hanging on the rail.

According to an embodiment of the invention, the lighting control means may also comprise a camera adapted to detect objects hanging on the rail. The pictures taken from camera may be processed with computer vision techniques in order to detect for example the position of orientation of objects and from this infer user actions.

The light system according to the invention may be for example applied to a clothing rack, a curtain rail, a rack for hanging kitchen tools, a playrack for children, or steps in ladders. In the latter case, the light system may be used to illuminate a bucket with paint hanging on a step. It is clear for a skilled person that the light system according to the invention may be applied to numerous applications where an automatic localized light is required or desired.

According to a further embodiment of the invention, a sensor and light module is provided which comprises at least one light emitting device and at least one sensor for detecting an object hanging on the module, wherein the module is adapted to form together with further modules a part of a light system according to the invention, for example for a rail with an integrated light. This embodiment allows to create a module system for creating for example a rail as part of the light system according to the invention with different lengths which is universally applicable. For example, a module may comprise one light emitting device and one sensor provided for controlling the light emitting device. To create a rail for application with a light system according to the invention, several modules may for example be "clicked" to each other in a way that creates sufficient mechanical stability and allows for the power supply of neighboring modules.

In order to accomplish an easy electrical connectivity of the single modules, a module may comprise a first and a second end each comprising electrical connectors for connecting with second and first ends, respectively, of another module. Thus, several modules may be electrically connected by assembling one module with another module.

Furthermore, the invention relates to a computer program enabled to carry out the method for creating a localized light according to the invention when executed by a computer. The invention also provides a record carrier storing this computer program.

Finally, the invention relates according to an embodiment to a computer programmed to perform a method for creating a localized light according to the invention and comprising communication means for communicating with one or more light systems according to the invention in order to receive signals from at least one sensor and to create control signals depending on the received sensor signals for adjusting the light from the lighting means.

These and other aspects of the invention will be apparent from and elucidated with reference to the embodiment(s) described hereinafter.

The invention will be described in more detail hereinafter with reference to exemplary embodiments. However, the invention is not limited to these exemplary embodiments.

Figure 4:
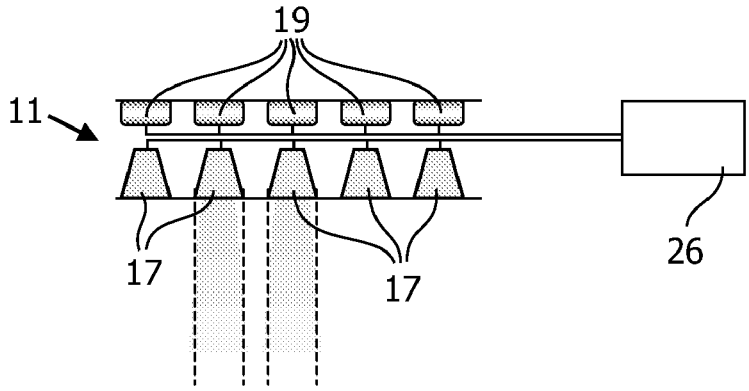
Figure 5:
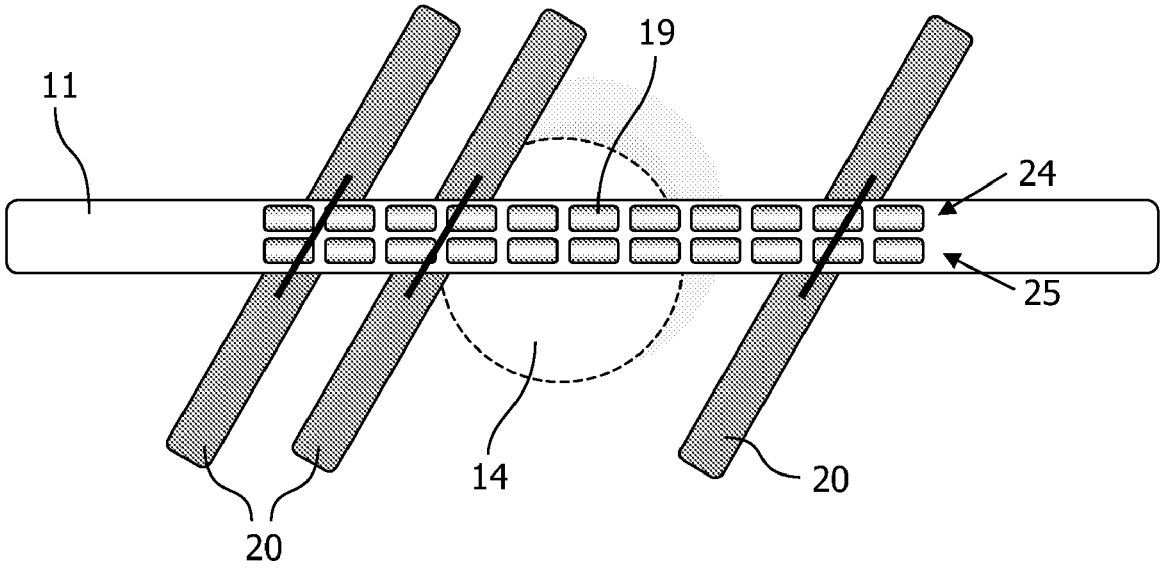

FIG. 4 shows a section through an embodiment of a clothing rail of a light system according to the invention with integrated LEDs and sensors, wherein a central controller receives signals from the sensors and controls the LEDs depending on the received signals; and FIG. 5 shows a top view of an embodiment of a clothing rail of a light system according to the invention with two parallel rows of sensors for detecting the hanging position of clothing hanging on the rail and controlling the localized light depending on the hanging position.

In the following, functional similar or identical elements may have the same reference numerals.

Figure 1:
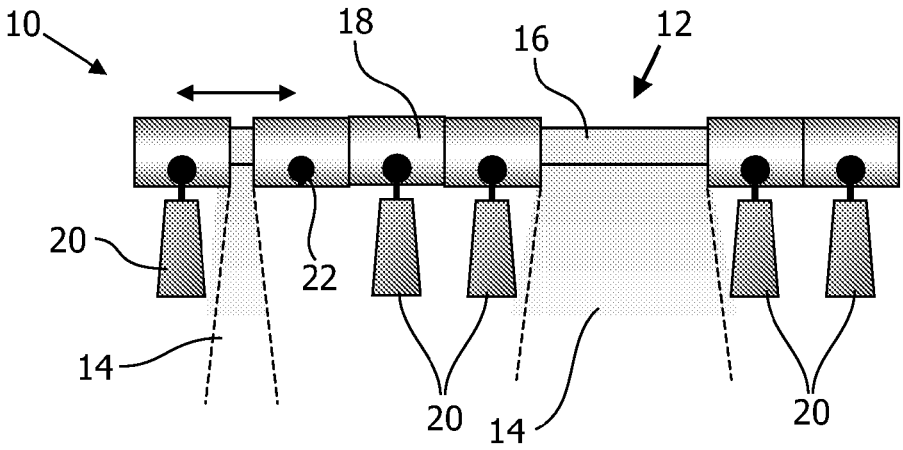
FIG. 1 shows a first embodiment of a light system according to the invention containing a clothing rail with a fluorescent tube and sleeves as mechanical lighting control means.

FIG. 1 shows a clothing rail 10 of a light system according to the invention which comprises a florescent tube 16 as lighting means 12 and several sleeves 18 mounted on the fluorescent tube 16. The sleeves 18 comprises holes 22 as connections for clothes hangers 20. The sleeves 18 may be moved on the fluorescent tube 16 as indicated by the double arrow for browsing clothing hanging on the clothes hangers 20. The shown clothing rail 10 may be for example applied to a clothing rack or a wardrobe. The movable sleeves 18 serve also as a kind of aperture blacking out the light emitted from the fluorescent tube 16 and, thus, creating a localized light 14 where openings are created between neighboured sleeves 18. Typically, openings are created when browsing through clothing hanging on the rail 10 at the location where a user desires to see some clothing in more detail. The area illuminated by the localized light 14 depends on the opening between two or more neighboured sleeves 18 as it is shown in FIG. 1. The left opening is smaller than the right opening, thus creating a localized light 14 in a smaller area than the localized light 14 created by the right opening. Therefore, the sleeves 18 serve as lighting control means controlling the localized light 14 created by the opening between the sleeves 18. The fluorescent tube 16 must be switched on in order to create localized light 14. The sleeves 18 simply block the light emitted from the fluorescent tube 16. In order to withstand the load of clothing hanging on the rail 10, the fluorescent tube 16 should be reinforced, for example by metal rods on its outer surface or by integrating it into a hollow stable rail with openings for the light of the fluorescent tube 16.

Figure 2:
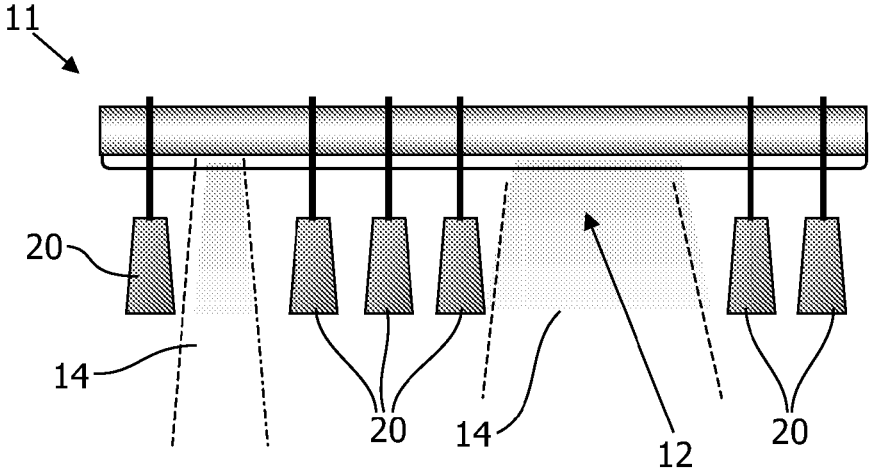
FIG. 2 shows a second embodiment of a light system according to the invention containing a clothing rail with LEDs integrated into the rail and sensors for detecting the position of hangers hanging on the rail.
Figure 3:
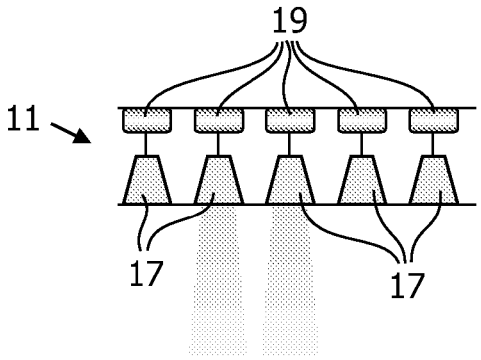
FIG. 3 shows a section through an embodiment of a clothing rail of a light system according to the invention with integrated LEDs and sensors, wherein each LED is controlled by its own sensor.

FIG. 2 shows an alternative clothing rail 11 of a light system according to the invention which comprises a metal rail with integrated sensors 19 as lighting control means and integrated LEDs 17 as lighting means (see FIG. 3). Clothing hangers 20 may be hanged on the clothing rail 11. Localized light 14 is created by switching on LEDs 17 at positions where no clothing hanger 20 hangs on the rail 11, or generally speaking in the gaps between the clothing hanging on the rail 11, thus illuminating the clothing forming the gap. In contrast to the clothing rail 10 from FIG. 1, the localized light 14 is created electronically by switching on or off LEDs 17 depending on the positions of the clothing hangers 20 on the rail 11. The position of the clothing hangers 20 is detected by the sensors 19 which may be pressure sensors detecting a pressure from a hanger 20, capacitive sensors detecting a capacity change when a hanger is moved away from, hanged on or moved over a sensor, and/or resistance sensors detecting a resistance change when a hanger is moved away from, hanged on or moved over a sensor.

FIG. 3 shows in a sectional view of the clothing rail 11 the location of the LEDs 17 and the sensors 19. The sensors 19 are connected directly to the LEDs 17. Thus, each LED 17 is controlled by its own sensor 19. A sensor 19 may be located above the controlled LED 17. If a sensor 19 detects a hanger, it switches off the controlled LED 17. If a sensor 19 does not detect anything, it switches on the controlled LED 17. A sensor 19 may be implemented that the switching transitions between on and off and vice versa may be instant or more soft (gradually over a certain time period), for instance that the localized light fades on in for example about 0.5 seconds. The rail 11 may be also implemented by sensor 19 and LED 17 modules. For example, each module may contain a single sensor 19 and a single LED 17 controlled by the sensor and some further electronics for controlling the switching on and off of the LED 17 such as a fading of the light. Furthermore, each module may be designed such that it is compatible with other modules in that it may be easily connected with neighboring modules, for example be "clicked" with another module. Thus, the rail 11 may be formed with different lengths depending on the number of modules. It should also be noted that each module may comprise electrical connections for a power supply. This modular system allows to flexibly implement different rails 11. Furthermore, the connection between modules requires a sufficient mechanical stability for the load which may be hanged on the rail 11.

FIG. 4 shows another and more advanced embodiment of a clothing rail 11 with a central controller 26 for controlling the switching of the LEDs 17. This allows for more complex and advanced behavior of the localized light created by the LEDs 17. Each sensor 19 and each LED 17 is connected to the central controller 26 which receives signals from the sensors 19 detecting whether a hanger hangs on the rail 11 or not. The central controller 26 processes the received sensor signals and controls the LEDs 17 according to a control algorithm implemented in the central controller 26. The algorithm may implement a control scheme which for example creates a more intense localized light at the sides of a gap between hangers hanging on the rail 11 than in the middle of the gap. Thus, for example clothing hanging at the sides of the gap is illuminated by the more intense light which makes it easier for a shopper to see the colors and further characteristics of the clothing. Furthermore, the algorithm could also control the creation of localized light in that if a user moves hangers aside the localized light could follow that movement with a delay and dim where there is no clothing at all. Also, it would be possible to dim or switch off one or more LEDs 17 after a certain amount of time if no movement of hangers is detected by the sensors 19. It should be noted that further control schemes and strategies may be implemented by the central controller 26. The controller 26 may be programmable and contain a memory for the algorithm implementing the controlling of the LEDs 17 depending on the position of hangers hanging on the rail 11 and detected by the sensors 19. The central controller 26 may also be implemented by a computer executing a computer program which processes the sensor signals and generates control signals for controlling the LEDs 17. For example, the computer may be connected with an interface of the rail 11. The computer may communicate with the rail 11 over a wire line or wireless connection, for example a bluetooth® or wireless LAN (local area network) connection. The program may also be implemented to control several different clothing rails 11 for example in a shop with a single computer which may be located in a back room and execute the program to control the creation of localized lights and communicate with the clothing rails via a wireless connection.

FIG. 5 shows a further embodiment of a clothing rail 11 in top view. The rail 11 comprises two lines or rows, respectively, 24 and 25 of sensors 19 which are arranged in parallel. This allows to detect the position of clothing hangers 20 on the rail 11 and, furthermore, the position of a hanger 20 with regard to the rail 11 as can be seen with the clothing hangers 20 diagonally hanging on the rail 11. The creation of a localized light 14 may be controlled by a central controller. The central controller receives the detection signals from the sensors 19. Furthermore, the central controller knows the position of each sensor 19 on the rail 11. If the central controller detects that two sensors 19, which are placed diagonally on the rail 11, detect a clothing hanger 20, it may detect that the clothing hanger 20 diagonally hangs on the rail 11. Then, the central controller may switch on LEDs 17 on the bottom side of the rail 11 which are located close to the side of clothing hanging on the clothing hanger 20 so that the side of the clothing facing forward to a user browsing and watching clothing hanging on the rail 11 is illuminated, and the side of other clothing facing backward from the user is not illuminated. In FIG. 5, this is shown by the circle of the localized light 14 which is located close to the forward facing side of clothing hanging on the rail 11. It should be noted that further strategies and schemes to control the creation of localized light may be implemented by processing the detection signals from the two parallel lines 24 and 25 of sensors 19 implemented in the rail 11.

The invention has the main advantages that it automatically creates a localized light and, therefore, does not require a direct user interaction for controlling the localized light.

The functionality of the invention, particularly the controlling of the creation of a localized light may be performed by hard- or software. In case of an implementation in software, a single or multiple standard microprocessors or microcontrollers may be used to process a single or multiple algorithms implementing the invention.

It should be noted that the word "comprise" does not exclude other elements or steps, and that the word "a" or "an" does not exclude a plurality. Furthermore, any reference signs in the claims shall not be construed as limiting the scope of the invention.

The invention claimed is:

1. A light system for creating a localized light comprising lighting means, and lighting control means adapted to create the localized light by adjusting the light from the lighting means responsive to user actions towards objects hanging on a rail and comprising a plurality of sensors integrated into the rail and adapted to detect whether a hanger is hanging on the rail, wherein each of the plurality of sensors controls at least one light emitting device depending on the detection of a hanger.

2. The light system according to claim 1, wherein the lighting means are integrated in the rail and distributed over a predefined length of the rail.

3. The light system according to claim 1, wherein the lighting means are integrated in a separate unit which is adapted to communicate with the lighting control means.

4. The light system according to claim 1, wherein the lighting control means are adapted to detect user actions by means of further detecting the position or orientation of the hanger hanging on the rail.

5. The light system according to claim 1, wherein the lighting control means are adapted to detect user actions by means of detecting touching or moving of the hanger hanging on the rail.

6. The light system according to claim 1, wherein the lighting means are implemented by at least one fluorescent tube.

7. The light system according to claim 1, wherein the plurality of sensors are implemented in one or more sleeves or covers movably integrated into the rod comprising the lighting means, wherein at least one of the sleeves or covers comprise at least one connection for the hanger.

8. The light system according to claim 1, wherein each sensor is located in the neighborhood of the light emitting devices controlled by the respective sensor.

9. The light system according to claim 1, wherein the sensors are arranged in a line on the rail.

10. The light system according to claim 1, wherein a further line of sensors is arranged in parallel to the first line of sensors on the rail.

11. The light system according to claim 1, wherein at least one sensor of the plurality of sensors is a pressure sensor, capacitive sensor and/or resistance sensor.

12. The light system according to claim 1, further comprising a central controller which receives signals from the sensors and which is adapted to control the switching on and off of the light emitting devices depending on the received sensor signals.

13. The light system according to claim 1, wherein the lighting means comprise one or more light emitting diodes.

14. A light system for creating a localized light comprising lighting means, and lighting control means adapted to create the localized light by adjusting the light from the lighting means responsive to user actions towards objects hanging on a rail and comprising at least one sensor integrated into the rail and adapted to detect whether a hanger is hanging on the rail and to switch off the controlled light emitting devices when detecting the hanger, and to switch on the controlled light emitting devices when no hanger is detected.

15. The light system according to claim 14, wherein the at least one sensor is implemented by one single sensor covering the length of the rail.

16. The light system according to claim 14, wherein a switching of the controlled light emitting devices has a soft transition.

17. The light system according to claim 14, wherein a sensor is a pressure sensor, capacitive sensor and/or resistance sensor.

18. The light system according to claim 14, further comprising a central controller which receives signals from the at least one sensor and which is adapted to control the switching on and off of the light emitting devices depending on the received sensor signals.

19. The light system according to claim 14, wherein the lighting means comprise one or more light emitting diodes.

20. The light system according to claim 14, wherein the lighting control means are adapted to detect user actions by means of detecting touching or moving of the at least one hanger hanging on the rail.

21. The light system according to claim 14, wherein the lighting means are integrated in a separate unit which is adapted to communicate with the lighting control means.

* * * * *